United States Patent [19]

Nishimura

[11] 4,249,761

[45] Feb. 10, 1981

[54] LOCKING ASSEMBLY FOR DOORS AND THE LIKE OF A BOX BODY

[75] Inventor: Tamotsu Nishimura, Osaka, Japan

[73] Assignee: Futaba Kinzoku Kogyo Kabushiki Kaisha, Osaka, Japan

[21] Appl. No.: 43,643

[22] Filed: May 30, 1979

[51] Int. Cl.[3] ..... E05C 17/56

[52] U.S. Cl. ..... 292/251.5; 292/332; 292/DIG. 4

[58] Field of Search ..... 292/DIG. 4, 251.5, 336, 292/332

[56] References Cited

U.S. PATENT DOCUMENTS

| | | | |
|---|---|---|---|
| 2,497,425 | 2/1950 | Terry | 292/DIG. 4 |
| 3,862,773 | 1/1975 | Bishing | 292/DIG. 4 |
| 3,934,909 | 1/1976 | VanNatter | 292/DIG. 4 |

FOREIGN PATENT DOCUMENTS

| | | | |
|---|---|---|---|
| 70861 | 10/1975 | Australia | 292/251.5 |

*Primary Examiner*—Richard E. Moore

*Attorney, Agent, or Firm*—Wenderoth, Lind & Ponack

[57] ABSTRACT

A locking assembly for doors and the like having a ring in a predetermined position in a cylindrical body so as to be rotatable in the circumferential direction. Projections are provided on the inner peripheral face of the ring. A sliding rod is fitted into the body so as to be slidable in the axial direction and has a concave groove on the peripheral face thereof. Serriform guides are provided on the opposite walls of the groove, the positions of the apexes of the guides being off set from each other. Axial slide grooves on the surface of the rod communicate with the trough of one of the guides at one end and are closed at the other end. The projections on the ring are fitted into the grooves and a magnet is mounted on the opposite end of the sliding rod from the slide grooves. A spring urges the sliding rod toward the magnet.

1 Claim, 4 Drawing Figures

LOCKING ASSEMBLY FOR DOORS AND THE LIKE OF A BOX BODY

The device relates to a locking assembly for a forwardly openable door or an upwardly openable lid. The device enables to simplify the opening and closing operation of a door and the like.

Locking assemblies comprising magnets for forwardly openable doors of sinks and upwardly openable lids of record players have already been known. Furthermore, in respect of locking assemblies comprising magnets, the device enabling to displace the doors forwardly or upwardly by manually pushing the doors has also been known. In the latter instance, the locking assembly is usually mounted on the inside edge adjacent the opening of the box body. Thus, the locking assembly projects toward the interior of the box body. It has a disadvantage, therefore, in that not only it constitutes an obstacle when things are put in and out of the box body but also it is awkward in appearance.

The present device enables to solve the aforementioned difficulties. A preferred embodiment of the device will now be described in detail in reference to the accompanying drawings.

Figure 1:
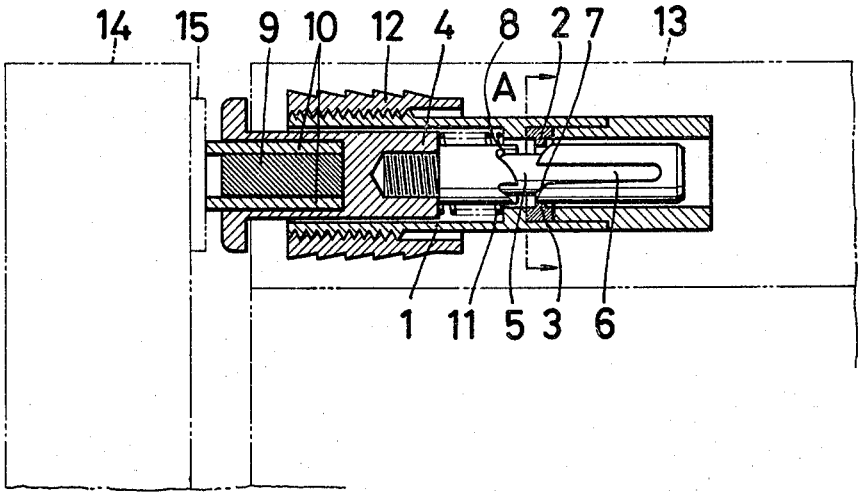
FIG. 1 is a sectional elevation of a preferred embodiment of the device when the door is closed.

The numeral 1 designates a cylindrical body, 2 designating a ring fitted to a part of the inside of the body 1, the ring 2 being fitted, for example, into a groove formed on the inner periphery of the body 1 so that it is circumferentially rotatable in its predetermined position. The numeral 3 designates engaging projections provided in a suitable number on the inner periphery of the rings 2, 4 designating a sliding rod slidably fitted into the body 1, 5 designating a concave groove annularly formed on the periphery of the sliding rod 4, 6 designating slide grooves provided on the surface of the sliding rod 4 in the axial direction thereof so as to be open at one end to the concave groove 5 and closed at the other end, respectively, the grooves 5, 6 being adapted to slidably receive the projections 3 of the ring 2. The numeral 7 designates a substantially serriform guide formed along the concave groove 5 and the slide groove 6 in such manner that the projecting part thereof is declined whilst the other part thereof is axially in parallel with the sliding rod 4.

The numeral 8 designates a serriform guide similar to the guide 7 formed along the concave groove opposite to said guide 7, the guides 7 and 8 having their apexes shifted from each other so that, for example, the apex of one of the guides corresponds to the intermediate part between the apex and the trough of the other guide, the slide groove 6 being provided in the trough of the guide 7. The numeral 9 designates a magnet embedded in the end portion of the sliding rod 4 opposite to the slide grooves 6, 10 designating metal plates abutting the magnet 9 and projecting relatively beyond the end of the sliding rod 4, 11 designating a spring provided in the body 1 for urging the sliding rod 4 toward the magnet 9, 12 designating a fixing bush screwed onto the outer periphery of the body 1, the body 1 and the bush 12 being reciprocatable with each other. The numeral 13 designates a side wall of a box body, 14 designating a door, 15 designating a metal plate secured to the door 14.

The locking assembly according to the device is of a construction as described hereinbefore. When the locking assembly is to be mounted on a box body, for example, a sink, a hole is provided on the frontage of the box body if it has a forwardly openable door, thereby enabling to fit and secure the body 1 thereinto. If a fixing bush 12 as shown in the embodiment is embedded in the frontage of the box body and then the body 1 is screwed thereinto, the body 1 is reciprocatable and adjustable with simplicity relative to the box body. However, it is optional whether a bush 12 is provided or not, since the body 1 can be embedded directly in the frontage of the box body. A metal plate 15 is secured to the inside of the door so as to correspond with the body 1.

Figure 2:
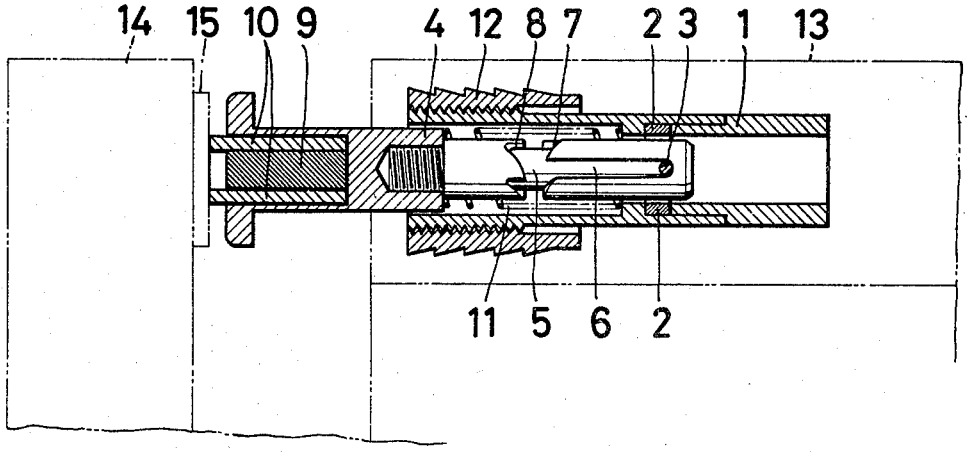
FIG. 2 is a sectional elevational of the same when the door is detached.
Figure 3:
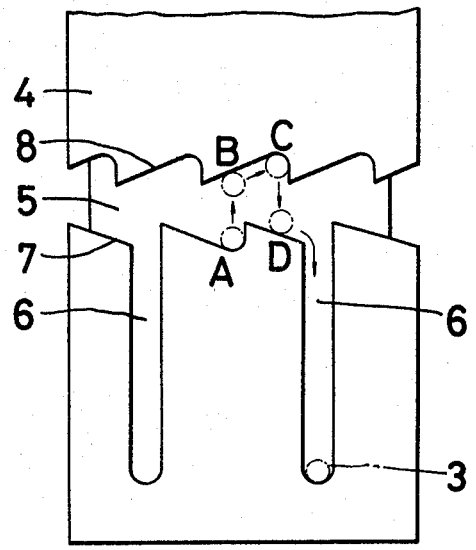
FIG. 3 is an expanded diagram showing the guide portion.
Figure 4:
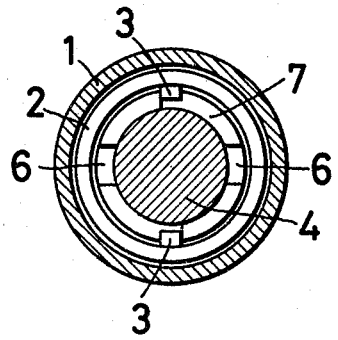
FIG. 4 is a sectional view, on a magnified scale, taken along the line A—A.

The door is opened and closed in the ordinary manner. To lock the door, the door is closed and then pushed relatively forcefully toward the box body. The sliding rod 4 fitted into the body 1 is secured thereto, the magnet 9 attracting the door with interposition of the metal plates 10, 15 thereby enabling to lock the door. As shown in FIG. 1, the guide 7 is caught on the projection 3 of the ring 2. To open the door, a second push is given to the door thereby enabling the sliding rod 4 to be released from the body 1. Then, the projection 3 is displaced along the guides 7, 8 in the direction indicated by arrows in FIG. 3. To be more precise, the projection 3 is displaced from (A) to (B) of the slope of the guide 8 and then to (C) along said slope thereby causing the ring 2 to rotate. Then, when the door is released from the push, the sliding rod 4 is urged forwardly out of the body 1 by the resilience of the spring 11, whereby the projection is displaced to (D) of the slope of the guide 7. With a further advance of the sliding rod 4, the projection 3 is displaced along the slope of the guide 7 until it is positioned in the slide groove 6. Thus, the sliding rod 4 projects fully beyond the body 1 as shown in FIG. 2 thereby enabling the door to be detached from the box body. Now, the door can be opened manually by holding the upper edge thereof.

The door can be closed by fitting the sliding rod 4 into the body 1 with interposition of the door. Thus, the projection 3 is brought into contact with the slope of the guide 8, said projection 3 being brought into contact with the slope of the guide 8 and engaged therewith whereby the sliding rod 4 is retained in the body 1 as shown in FIG. 1. Thus, the door is locked by the magnetic attraction acting through the metal plates 10, 15.

As described hereinbefore, the locking assembly according to the device enables to retain the door in the closed state and detach it from the box body simply by giving it a manual push. It enables to open and close the door with simplicity, and moreover renders it unnecessary to provide the door with a knob which is unseemly and cumbersome. An upwardly openable door can be opened by pushing it downwardly.

Furthermore, since the locking assembly according to the device comprises a cylindrical body, it can be embedded in the side wall of the box body simply by providing a hole thereon. It is not only seemly to the eye but also unobstructive to the use of the interior of the box body. Moreover, a fixing bush 12 can be screwed reciprocatably onto the body 1. If the body 1 is provided with a bush 12, the body can be installed with simplicity by mounting the bush on the side wall of the box body and then screwing the body 1 thereinto. Simultaneously, the projection of the metal plates 10 beyond the side wall of the box body can be adjusted with simplicity by the reciprocation of the body 1 thereby enabling to increase the efficiency of the installing operation of the body 1. However, this is not a restrictive construction since the body 1 can be embedded directly in the side wall of the box.

The sliding rod 4 is locked or displaced by providing serriform guides 7, 8 on the opposite walls of the concave groove 5 formed on its periphery and guide grooves 6 communicative with the troughs of the guides 7, whereby a ring 2 is rotated with interposition of projections 3 thereof by the reciprocation of the sliding rod 4. Thus, the locking assembly operates with reliability and can be reduced in size with simplicity. The locking assembly according to the device, therefore, has an advantage in that it is producible at lower cost than the conventional locking assembly with improved durability.

What is claimed is:

1. Locking assembly for doors and the like of a box body comprising a ring 2 provided in a predetermined position in a cylindrical body 1 so as to be rotatable in its circumferential direction, projections 3 being provided on the inner peripheral face of the ring 2, a sliding rod 4 being fitted into the body 1 so as to be slidable in its axial direction, a concave groove 5 being formed on the peripheral face of the sliding rod 4, serriform guides 7, 8 being provided on the opposite walls thereof, the positions of the apexes of the guides 7, 8 being shifted from each other, slide grooves 6 each communicative with the trough of the guide 7 at one end and closed at the other end being formed on the surface of the sliding rod 4 in the axial direction thereof, the projections 3 being fittable into the grooves 5, 6, a magnet 9 being mounted on the end of the sliding rod 4 opposite to the slide grooves 6, a spring 11 for urging the sliding rod 4 toward the magnet 9 being provided in the body 1.

* * * * *